US008957332B2

(12) United States Patent
Yamada

(10) Patent No.: US 8,957,332 B2
(45) Date of Patent: Feb. 17, 2015

(54) KEY SWITCH STRUCTURE

(75) Inventor: Shigeru Yamada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 183 days.

(21) Appl. No.: 13/542,650

(22) Filed: Jul. 5, 2012

(65) Prior Publication Data

US 2013/0043113 A1 Feb. 21, 2013

(30) Foreign Application Priority Data

Aug. 17, 2011 (JP) ..... 2011-178442

(51) Int. Cl.
*H01H 13/12* (2006.01)
*H01H 3/12* (2006.01)

(52) U.S. Cl.
CPC ..... *H01H 3/125* (2013.01); *H01H 2217/004* (2013.01)
USPC ..... 200/5 A; 200/344

(58) Field of Classification Search
CPC .... H01H 3/122; H01H 3/125; H01H 13/7065
See application file for complete search history.

(56) References Cited

U.S. PATENT DOCUMENTS 7,094,984 B2 * 8/2006 Yokoyama ..... 200/344
2002/0139841 A1 10/2002 Hsu et al.

FOREIGN PATENT DOCUMENTS

CN 2480906 Y 3/2002
CN 101894696 A 11/2010
JP 2011-049110 A 3/2011
JP 2012-022473 A 2/2012

OTHER PUBLICATIONS

Partial translation of a Japanese Office Action dated on Oct. 21, 2014.

* cited by examiner

*Primary Examiner* — Renee S Luebke
*Assistant Examiner* — Ahmed Saeed
(74) *Attorney, Agent, or Firm* — Rabin & Berdo, P.C.

(57) ABSTRACT

A key switch structure can include a key top, a link structure, a back plate, a membrane sheet, an elastic member, an arm bar, and a pushing member. The link structure can guide the key top in the pushing direction while the key top is pushed. The back plate can support the link structure. The membrane sheet can include a contact portion arranged on the membrane sheet and connectable, in response to a predetermined pressure, to an electrical contact to form a closed circuit. The elastic member can push and separate the key top from the back plate, and be elastically deformable. The arm bar can movably support the key top, and the arm bar can be supported movably at the back plate. The pushing member can push the link structure while the key top is pushed.

7 Claims, 18 Drawing Sheets

KEY SWITCH STRUCTURE

CROSS-REFERENCE TO RELATED APPLICATION

This application claims priority under 35 U.S.C. §119 from Japanese Patent Application No. P 2011-178442, filed on Aug. 17, 2011, the disclosure of which is incorporated herein by reference.

BACKGROUND

1. Technical Field

This application relates to a key switch structure. More specifically, it relates to the key switch structure that is appropriate for a rectangle shaped key top.

2. Description of the Related Art

Japanese Laid-Open Patent No. 2011-049110 describes conventional key switch structures. The key switch structure can include key tops that can be deformable by strength poverty of the key top. Therefore, a loose connection at a switch can occur in the key switch structure.

SUMMARY

This application discloses aspects of a key switch structure that can connect a contact part of a switch with a reduced failure rate.

According to one aspect, the key switch structure can include a key top, a link structure, a back plate, a membrane sheet, an elastic member, an arm bar, and a pushing member. The link structure, which can support the key top, can guide the key top so that the key top can move in the pushing direction while the key top is pushed. The back plate can support the link structure. The membrane sheet can be arranged on the back plate, and face toward the key top. Also, the membrane sheet can include a contact portion. The contact portion can be arranged on a surface of the membrane sheet and be connectable, in response to a predetermined pressure, to an electrical contact to form at least one closed circuit. The elastic member can be arranged between the key top and the membrane sheet. Also, the elastic member can push and separate the key top from the back plate, and be elastically deformable to transmit the predetermined pressure to the contact portion. The arm bar can be arranged along the longer direction of the key top. Also, the arm bar can movably support the key top. Also, a part of the arm bar can be supported movably at the back plate. The pushing member can be arranged at the arm bar. The pushing member can push the link structure while the key top is pushed.

BRIEF DESCRIPTION OF THE DRAWINGS

The key switch structure will be more fully understood from the following detailed description with reference to the accompanying drawings, which is given by way of illustration only, and is not intended to limit.

DETAILED DESCRIPTION

First Embodiment

Figure 1:
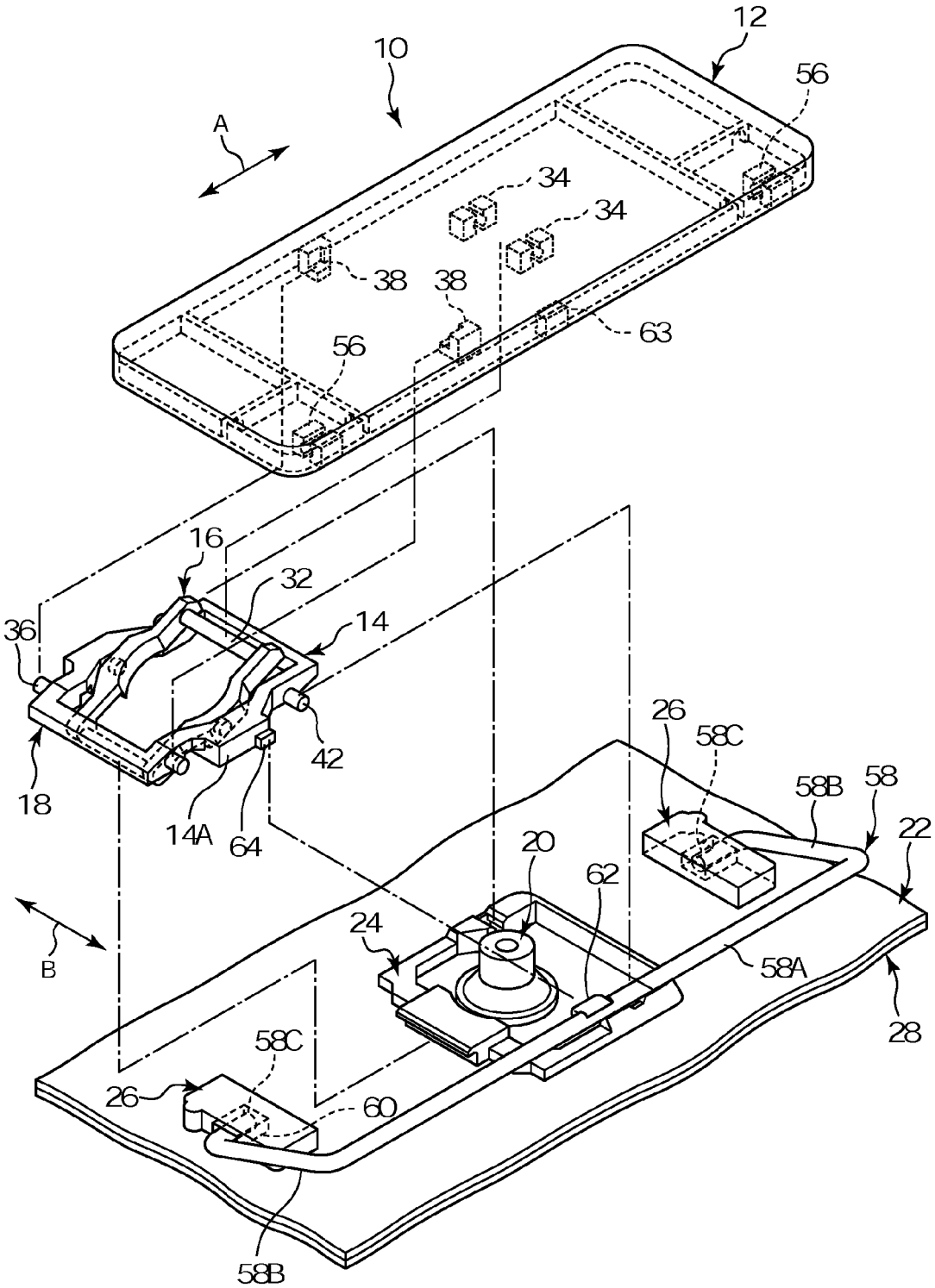
FIG. 1 is an exploded perspective view of the key switch structure according to a first embodiment.
Figure 2:
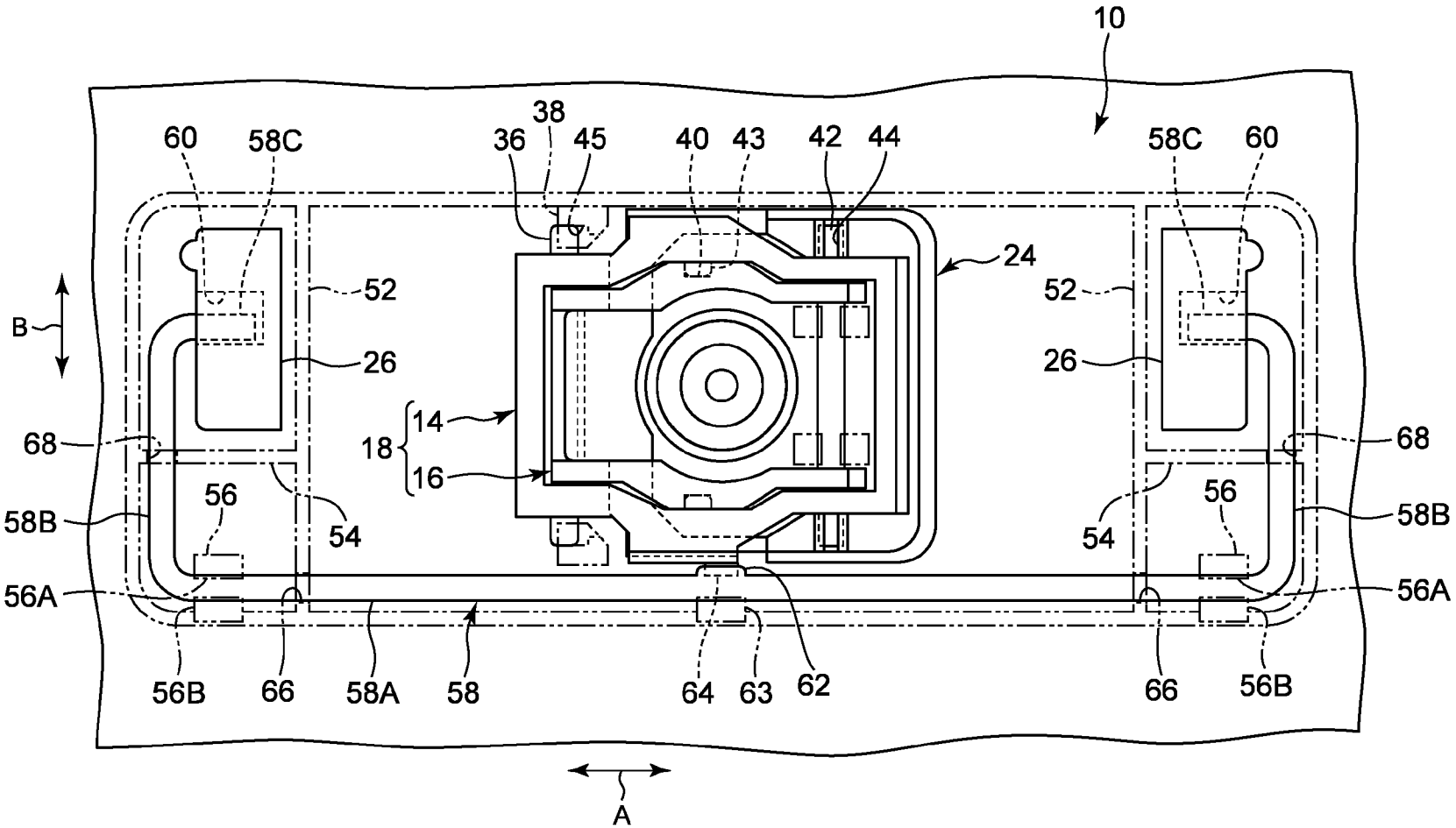
FIG. 2 is a plane view illustrating an inside of the key switch structure according to the first embodiment.
Figure 3:
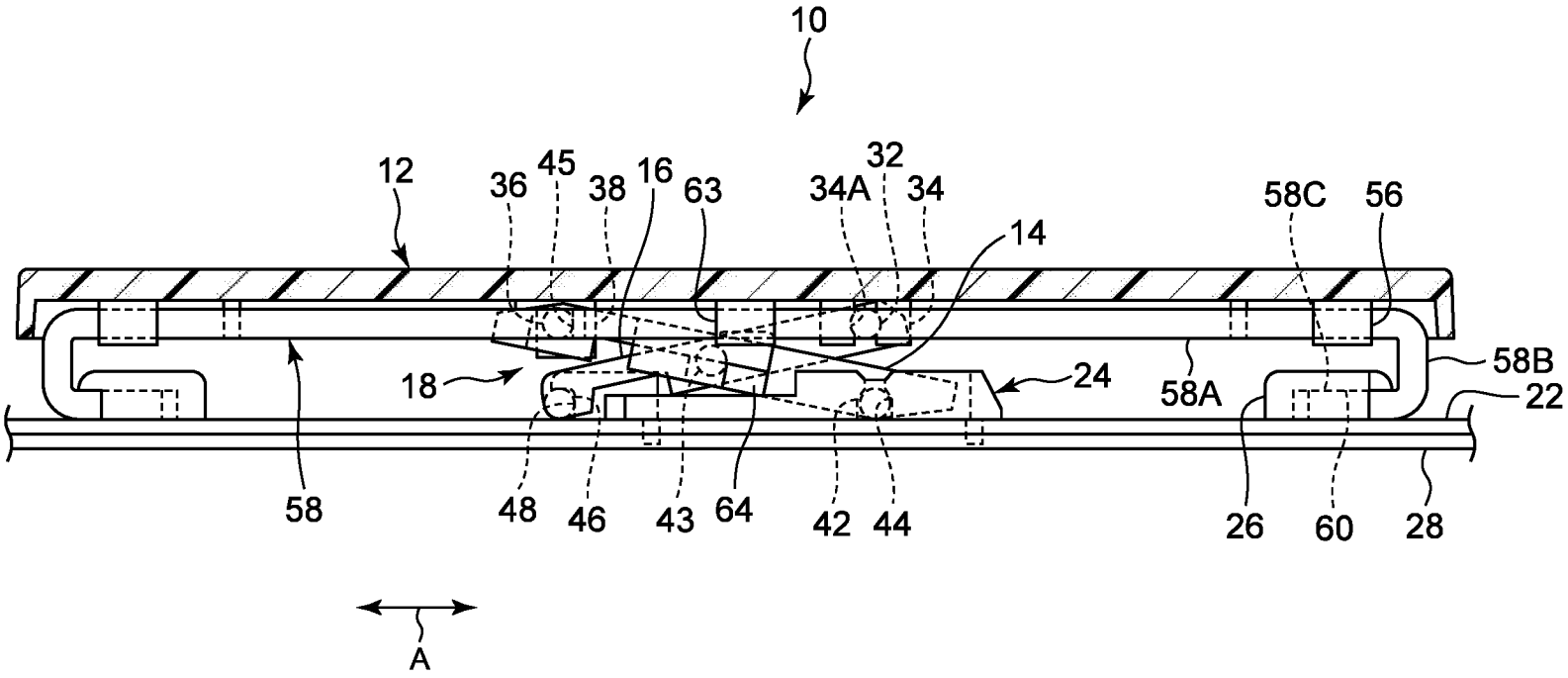
FIG. 3 is a cross-sectional view of the key switch structure according to the first embodiment.

A first embodiment of a key switch structure 10 will be described in reference to the figures. FIG. 1 is an exploded perspective view of the key switch structure 10 according to the first embodiment. FIG. 2 is a plane view illustrating an inside of the key switch structure 10 according to the first embodiment. FIG. 3 is a cross-sectional view of the key switch structure 10 according to the first embodiment. As shown in FIGS. 1-3, the key switch structure 10 can include a link structure 18 that can include a key top 12, an outside link member 14, an inside link member 16, a dome 20, a membrane sheet 22, and a back plate 28. A first holder 24 and second holders 26 can be fixed to the back plate 28 through the membrane sheet 22.

The back plate 28 can be a board formed from or including a material, such as a metal or a hard plastic, that has a predetermined hardness and stiffness. The membrane sheet 22 can be formed by upper and under sheets (not illustrated) that can be made of or include a soft material and that can have a printed wiring pattern. Also, the membrane sheet 22 can include a soft material sandwiched between the upper and under sheets. The membrane sheet 22 can be attached to the surface of the back plate 28. Also, the membrane sheet 22 can include holes (not illustrated) so that the holders 24 and 26 can penetrate through the membrane sheet 22.

Figure 4A:
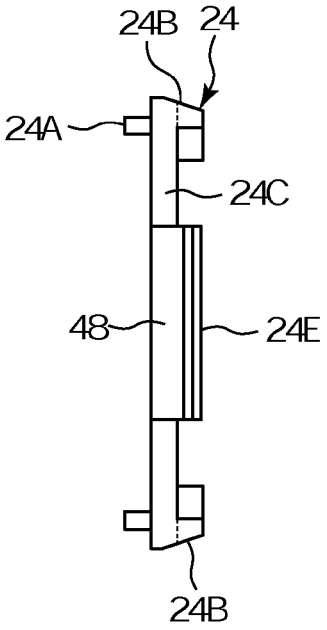
FIG. 4A is a side view of a first holder according to the first embodiment.
Figure 4B:
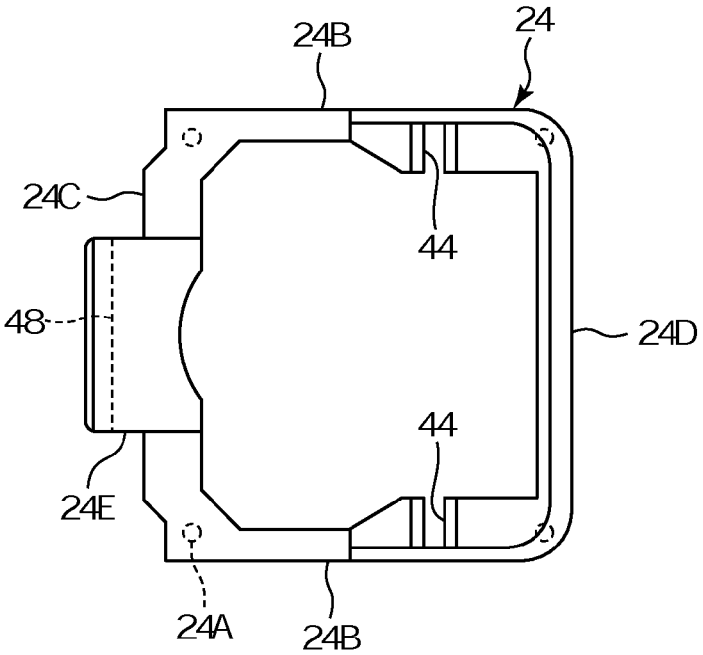
FIG. 4B is a plane view of the first holder according to the first embodiment.
Figure 4C:
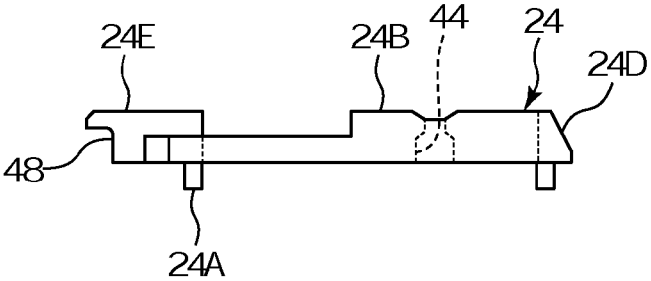
FIG. 4C is another side view of the first holder according to the first embodiment.

Next, the first holder 24 will be described. FIG. 4A is a side view of the first holder 24 according to the first embodiment. FIG. 4B is a plane view of the first holder 24 according to the first embodiment. FIG. 4C is another side view of the first holder 24 according to the first embodiment. As shown in FIGS. 4A-4C, the first holder 24 can be frame-shaped. Also, the first holder 24 can include a pin 24A at an under surface thereof so as to be inserted into the hole (not illustrated) formed on the back plate 28 so that the first holder can be fixed to the back plate 28.

Hinge grooves 44 that can open upward with respect to the key switch structure 10 and can extend in the B direction, can be formed at respective side parts 24B of the first holder 24. The side parts 24B can be substantially parallel to each other, and side parts 24B can be connected to each other by connecting parts 24C and 24D. A projection 24E can be formed at the connecting part 24C, and a groove 48 that can open outward of the first holder 24 can be formed at an end portion of the projection 24E.

Figure 5:
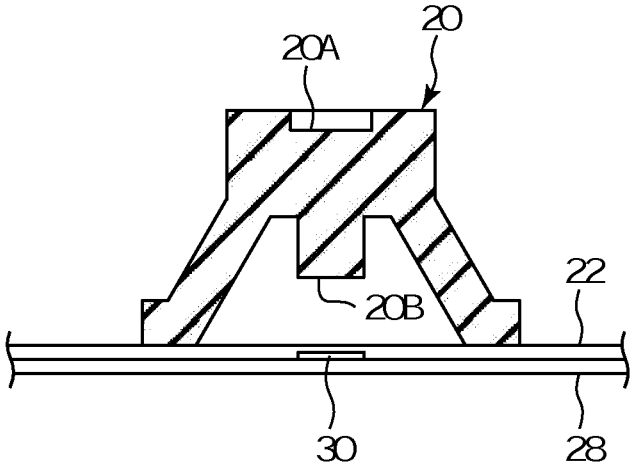
FIG. 5 is a cross-sectional view of a dome according to the first embodiment.

FIG. 5 is a cross-sectional view of the dome 20 according to the first embodiment. As shown in FIG. 5, the membrane sheet 22 can include a contact portion 30. The dome 20 can be fixed to the membrane sheet 22 at an upper side of the contact portion 30 by a bond. The dome 20 can be cup-shaped, and can be formed by an elastic member, such as a rubber member. Also the dome 20 can include a fitting hole 20A at the center upper side thereof, and a contact pushing member 20B that can project toward the membrane sheet 22 at the center inside thereof.

If the key top 12 is pushed by an operator, the key top 12 can move to the membrane sheet 22 (to the back plate 28) while keeping parallel to the membrane sheet 22, by operation of the link structure 18 that will be described below. During movement of the key top 12 from an original position toward the membrane sheet 22, the dome 20 can be pressed by the key top 12 and can be deformed. Then the contact pushing member 20B can contact and push the contact portion 30.

The upper and under sheets of the membrane sheet 22 can respectively include an electrical contact portion. The electrical contact portions can face toward and against each other at the position corresponding to the contact portion 30. If the membrane sheet 22 is pushed in a perpendicular direction by the contact pushing member 20B, the respective electrical contact portions can contact each other and connect electrically. Then, the circuit of the electrical contact portions, which can form an electrical switch, can enter or assume a closed condition.

If the operator releases the key top 12, and the key top 12 is released from pushing, the key top 12, the contact pushing member 20B, and the contact portion 30 can return to respective original positions by a restoring force (e.g., an elastic force) of the dome 20 and the membrane sheet 22. As a result, the membrane sheet 22 can be released from the pushing of the contact portion 30, and the electrical connection between the electrical contacts of the upper and under sheets can be released. Then, the circuit of the electrical contacts that can form the electrical switch can enter or assume an opened condition.

Figure 6C:
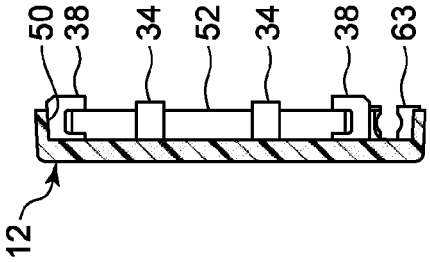
FIG. 6C is another cross-sectional view of the key top along a plane C-C in FIG. 6A.
Figure 6D:
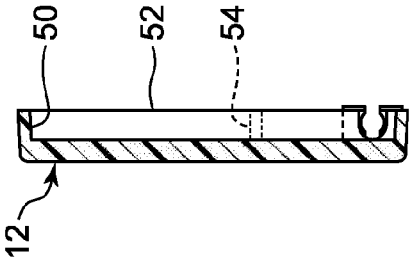
FIG. 6D is another cross-sectional view of the key top along a plane D-D in FIG. 6A.
Figure 6A:
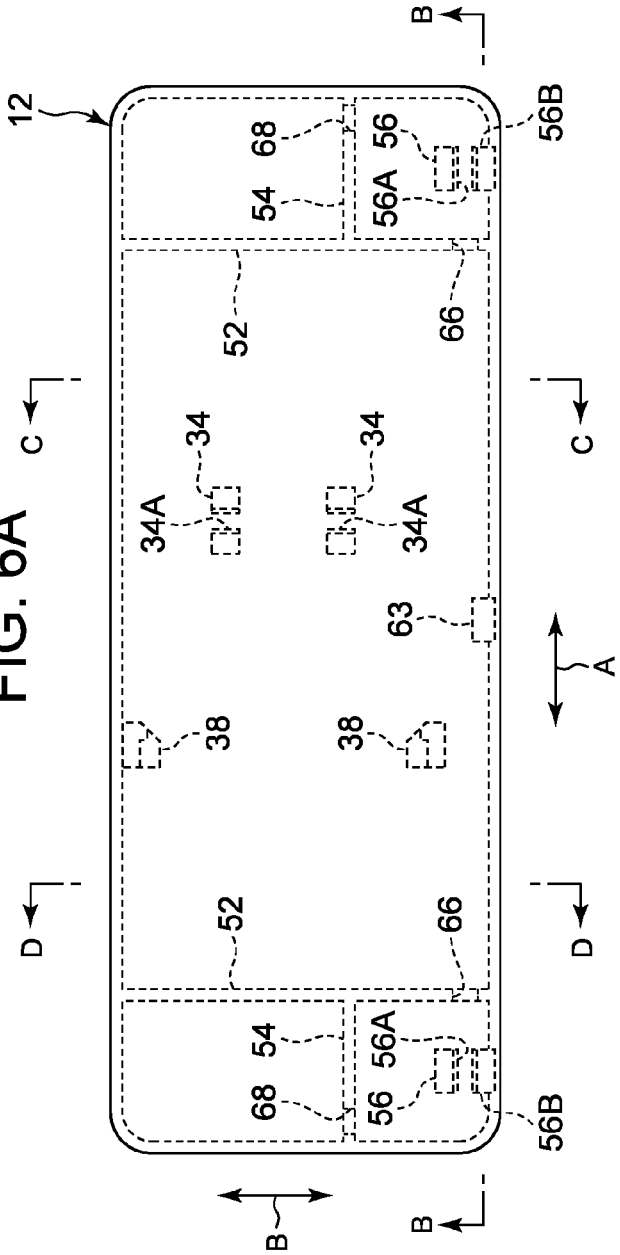
FIG. 6A is a plane view of a key top according to the first embodiment.
Figure 6B:
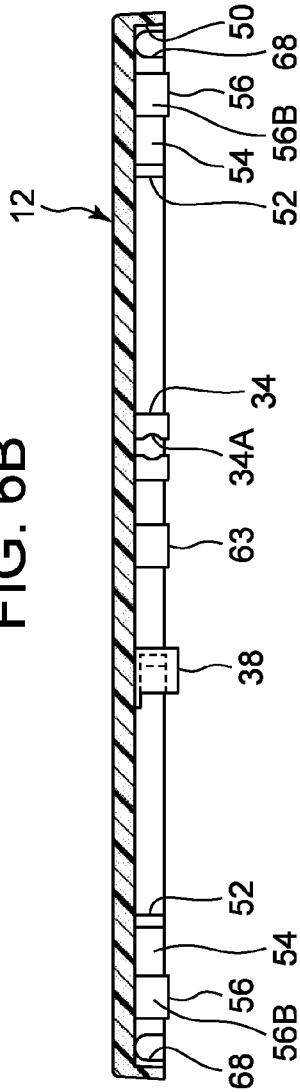
FIG. 6B is a cross-sectional view of the key top along a plane B-B in FIG. 6A.
Figure 7:
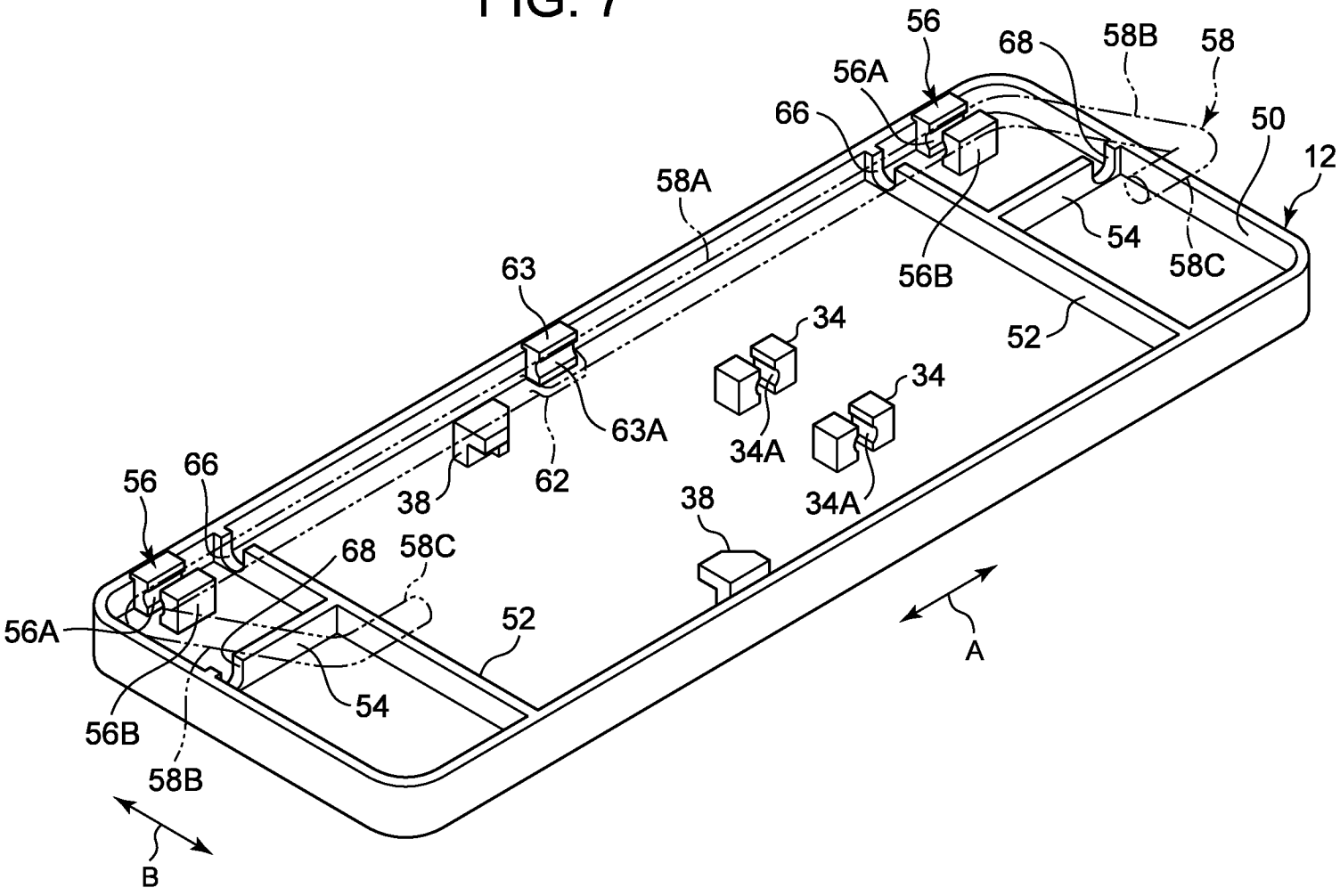
FIG. 7 is a perspective view of the key top shown in FIG. 1 rotated 180 degrees.

Next, the key top 12 will be described. FIG. 6A is a plane view of the key top 12 according to the first embodiment. FIG. 6B is a cross-sectional view of the key top 12 along a plane B-B in FIG. 6A. FIG. 6C is another cross-sectional view of the key top 12 along a plane C-C in FIG. 6A. FIG. 6D is another cross-sectional view of the key top 12 along a plane D-D in FIG. 6A. FIG. 7 is a perspective view of the key top 12 shown in FIG. 1 rotated 180 degrees. As shown in FIG. 1, FIG. 6, and FIG. 7, rotational supporting members 34 and slide supporting members 38 can be arranged on the back side of the key top 12 so as to face toward membrane sheet 22. The rotational supporting members 34 can support rotational shafts 32 arranged at one side of the inside link member 16 so that the shafts 32 can rotate. The slide supporting members 38 can support slide pins 36 arranged at one side of the outside link member 14 so that the slide pin 36 can rotate and move parallel in the horizontal direction with respect to the back side of the key top 12. Here, the key top 12 can be formed by a molded piece, made of or including, for example, synthetic resin.

Figure 8A:
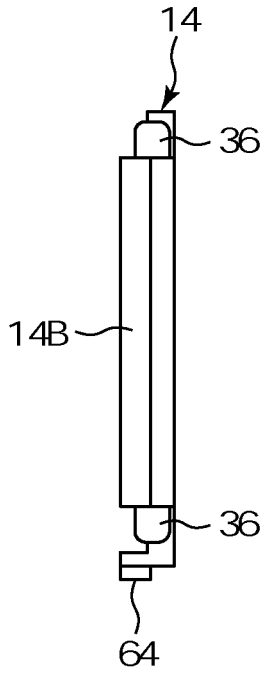
FIG. 8A is a side view of an outside link member according to the first embodiment.
Figure 8B:
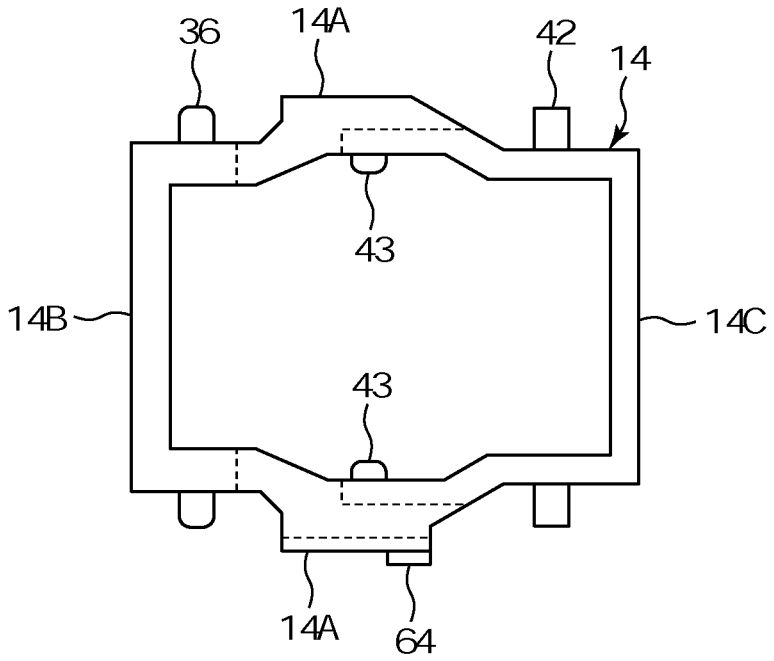
FIG. 8B is a plane view of the outside link member according to the first embodiment.
Figure 8C:
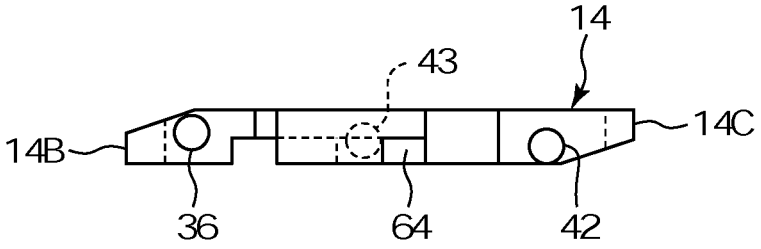
FIG. 8C is another side view of the outside link member according to the first embodiment.

Next, the outside link member 14 will be described. FIG. 8A is a side view of the outside link member 14 according to the first embodiment. FIG. 8B is a plane view of the outside link member 14 according to the first embodiment. FIG. 8C is another side view of the outside link member 14 according to the first embodiment. As shown in FIG. 1, 8A, 8B, 8C, and 8D, the outside link member 14 can be frame-shaped and include an opening portion disposed at substantially the center thereof into which the inside link member 16 can be inserted.

As shown in FIGS. 8A-8C, side parts 14A of the outside link member 14, which can be parallel to each other, can be connected to each other by connecting members 14B and 14C. The slide pins 36 can be arranged at respective outsides of the side parts 14A and opposite each other across the opening portion of the outside link member 14. The hinge pins 42 can be arranged at respective outsides of the side parts 14A and opposite each other across the opening portion of the outside link member 14.

As shown in FIG. 2, and FIG. 3, the hinge pins 42 can be inserted into the respective hinge grooves 44, and can be supported so as to be able to rotate. Therefore, the outside link member 14 can rotate on the rotational axes of the hinge pins 42 inserted into the respective hinge grooves 44.

Slide pin 36 can be supported at grooves 45 of the slide supporting member 38 so that the slide pin 36 can rotate and move parallel in the horizontal direction (e.g., in the A direction) with respect to the back side of the key top 12.

Figure 9A:
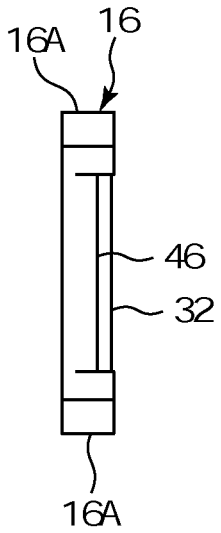
FIG.9A is a side view of an inside link member according to the first embodiment.
Figure 9B:
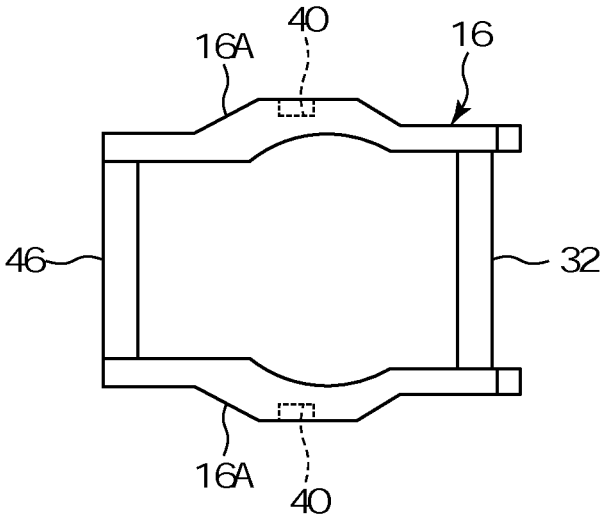
FIG.9B is a plane view of the inside link member according to the first embodiment.
Figure 9C:
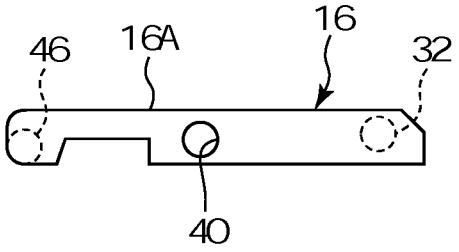
FIG.9C is another side view of the inside link member according to the first embodiment.

FIG.9A is a side view of the inside link member 16 according to the first embodiment. FIG.9B is a plane view of the inside link member 16 according to the first embodiment. FIG.9C is another side view of the inside link member 16 according to the first embodiment. As shown in FIGS. 2, 8, and 9, hinge shafts 43, which can be inserted into respective hinge holes 40 of the inside link member 16 (described below), can be arranged, substantially centrally, at respective inner lateral sides of the side parts 14A. Here, the outside link member 14 can be formed by a molded piece, made of or including, for example, synthetic resin.

Next, the inside link member 16 will be described. As shown in FIGS. 1, 2, and 9, the inside link member 16 can be frame-shaped and include an opening portion disposed at substantially the center thereof through which the dome 20 can penetrate. As shown in FIG. 9, hinge holes 40 into which the hinge shafts 43 can be inserted can be arranged at respective side parts 16A of the inside link member 16. The side parts 16A can be substantially parallel to each other, and can be connected to each other by a slide shaft 46 and the rotational shaft 32.

As shown in FIG. 3, the rotational shafts 32 can be supported at hinge grooves 34A of the rotational supporting member 34 so as to be able to rotate. Therefore, the inside link member 16 can rotate on the rotational axes of the rotational shafts 32 inserted into the hinge grooves 34A.

As shown in FIG. 3, and FIG. 4, the slide shaft 46 can be supported at the groove 48 so that the slide shaft 46 can rotate with respect to the groove 48 and move parallel in the horizontal direction (e.g., in the A direction) with respect to the surface of the membrane sheet 22.

As shown in FIG. 1, and FIG. 2, the inside link member 16 can be fitted into the outside link member 14, the hinge shafts 43 can be inserted into the hinge holes 40 so as to be able to rotate, and the link structure 18 can assume a shape resembling the letter X by juxtaposition of the outside link member 14 and the inside link member 16 (see also FIG. 3).

As a result, if the key top 12 is pushed by the operator, the hinge shaft 43 can rotate in the hinge hole 40. On the other hand, the slide shaft 46 and the slide pin 36 can move along the upper side of the membrane sheet 22 and the back side of the key top 12 as the key top 12 is pushed down. Here, the inside link member 16 can be formed by a molded piece, made of or including, for example, synthetic resin.

Next, the key top 12 and the arm bar 58 will be described. As shown in FIGS. 6A-6D, and FIG. 7, a rib 50 serving to provide additional strength and having a box-like design can be formed at the key top 12 along an outer circumference thereof. Ribs 52 that can extend in the B direction can be formed at both end sides of the back side of the key top 12, and substantially the center part of the rib 52 can be connected to the rib 50 through a rib 54 that can extend in the A direction.

Figure 10A:
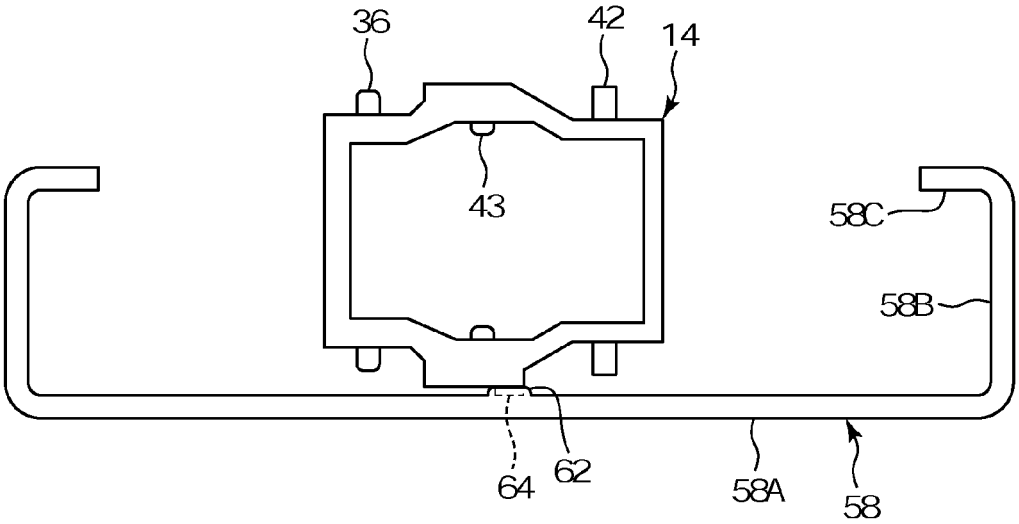
FIG. 10A is a plane view of the outside link member and an arm bar according to the first embodiment.
Figure 10B:
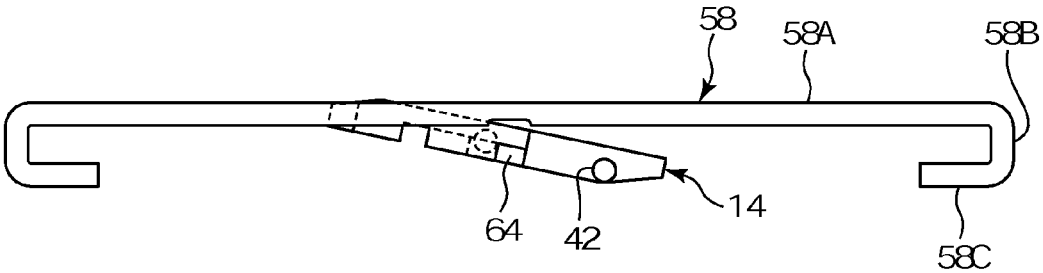
FIG. 10B is a side view of the outside link member and the arm bar while the outside link member and the arm bar are in a normal (e.g., unpressed or non-pressed) position.
Figure 10C:
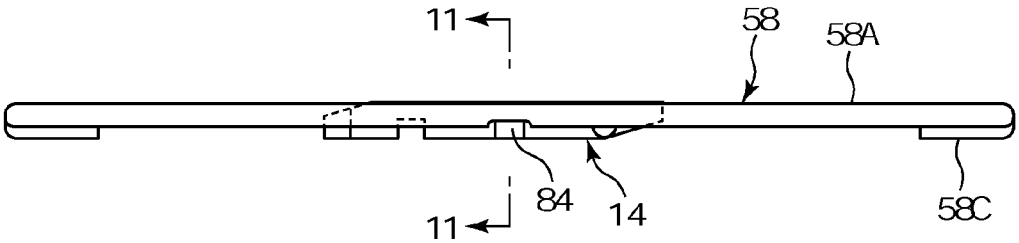
FIG. 10C is another side view of the outside link member and the arm bar while the outside link member and the arm bar are in a pressed position.

Supporting members 56 configured by a pair of stoppers 56B can be arranged at the back side of both end sides of the key top 12 along the A direction. A hinge groove 56A can be formed between the pair of stoppers 56B at the supporting member 56, and an arm bar 58 formed by, e.g., a metal wire that can be circular in cross-sectional, such as a stainless wire, can be inserted into the hinge groove 56A so as to be able to rotate with respect to the key top 12. E.g., the supporting member 56 can support the arm bar 58 so that the arm bar 58 can rotate and be kept at a predetermined position with respect to the key top 12. FIG. 10A is a plane view of the outside link member 14 and the arm bar 58 according to the first embodiment. FIG. 10B is a side view of the outside link member 14 and the arm bar 58 while the outside link member 14 and the arm bar 58 are in a normal (e.g., unpressed or non-pressed) position. FIG. 10C is another side view of the outside link member 14 and the arm bar 58 while the outside link member 14 and the arm bar 58 are in a pressed position. As shown in FIG. 7, and FIG. 10, the arm bar 58 can include a long part 58A arranged along the A direction of the key top 12, short parts 58B that can extend from both end sides of the long part 58A in the perpendicular direction with respect to the long part 58A, and a hinge parts 58C that can extend respectively from an end side of the short part 58B in the perpendicular direction with respect to the short part 58B.

The long part 58A can be arranged along a long lateral side of the rib 50, and the short part 58B can be arranged along a short lateral side of the rib 50. Also, the long part 58A can be supported at the hinge grooves 56A so as to be able to rotate, and the arm bar 58 can rotate on the rotational axis of the long part 58A.

Figure 11:
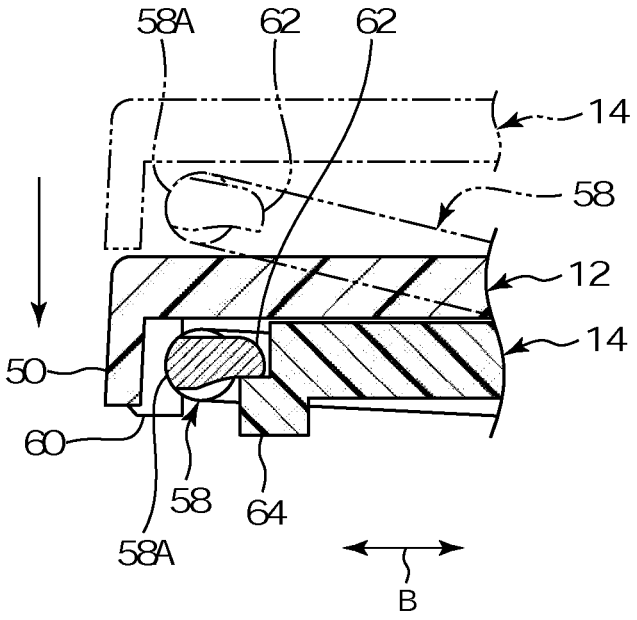
FIG. 11 is a cross-sectional view of a part of the outside link member and a part of the arm bar while the outside link member and the arm bar are in a pressed position.

As shown in FIG. 1 and FIG. 2, the hinge parts 58C can be inserted into supporting holes 60 of the second holders 26 that can have a shape of a square hole so that the hinge part 58 can rotate and slide in the B direction along the back plate 28. FIG. 11 is a cross-sectional view of a part of the outside link member 14 and a part of the arm bar 58 while the outside link member 14 and the arm bar 58 are in a pressed position. As shown in FIGS. 2, 10, and 11, a projection 62 serving as a pushing member that can project toward the link structure 18 can be formed at substantially the center of the long part 58A, e.g., the projection 62 can include a part of the long part 58A that projects beyond a main portion of the long part 58A. In this embodiment, the projection 62 can be formed by a pressing machine pressing a part of the long part 58A.

Figure 12:
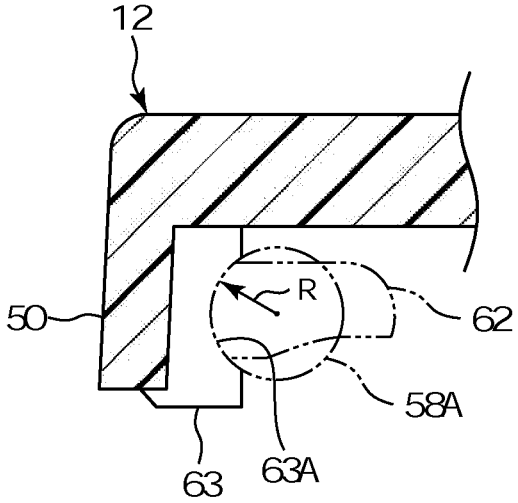
FIG. 12 is a cross-sectional view of a part of the key top according to the first embodiment.

FIG. 12 is a cross-sectional view of a part of the key top 12 according to the first embodiment. As shown in FIGS. 7, 11, and 12, a receiver 63 that can have a projection shape can be arranged at the back side of the key top 12. Also, a guide face 63A that can be arc-like concave (radius is R) can be formed at the receiver 63, and the long part 58A can be supported at the guide face 63A so as to be able to rotate.

As shown in FIGS. 1, 2, 10, and 11, a receiver 64 that can project outward of the outside link member 14 can be arranged at a lateral side of one of the side parts 14A so as to face toward the projection 62. The receiver 64 can be disposed on an underside with respect to the projection 62, and the projection 62 can be disposed so as to cover the receiver 64 in the plane view of the key top 12.

As shown in FIG. 11, in a normal condition, the projection 62 can be disposed on an upper side of the receiver 64 as shown by two-dot chain line in FIG. 11. If the long part 58A moves toward the underside as shown by the arrow, the projection 62 can contact the receiver 64 as shown by solid line in FIG. 11, and can push the receiver 64.

As shown in FIG. 2, and FIG. 6, back clearances 66 and 68 that can be incision-shaped can be formed respectively at the ribs 52 and 54 so as to avoid contacting the long part 18A and the short parts 18B.

In the key switch structure 10 of this embodiment, if the key top 12 is pushed by the operator, the key top 12 can move toward the membrane sheet 22 (toward back plate 28) while keeping parallel to the membrane sheet 22, and can push and deform the dome 20. As a result, the contact pushing member 20B can push the contact portion 30, and the respective electrical contact portions can contact each other and connect electrically. Then, the circuit of the electrical contact portions that forms an electrical switch can enter or assume a closed condition.

In conventional arts, if the end part of the longer direction of the key top 12 is pushed by the operator, it can occur that the pushing force applied to the key top 12 is not transferred to the link structure 18 by deforming of the key top 12. However, in the key switch structure 10 of this embodiment, even if the end part of the longer direction of the key top 12 is pushed by the operator, the pushing force applied to the key top 12 can be transferred to the link structure 10 through the key top 12 and the arm bar 58.

E.g., if the key top 12 is pushed by the operator, the arm bar 58 formed by a metal wire that has high rigidity can move to the underside. Then the projection 62 can contact the receiver 64 (shown in FIG. 10C and FIG. 11), the link structure 18 can be pushed so as to be lowered, the whole key top 12 can be moved toward the membrane sheet 22 while keeping parallel to the membrane sheet 22 and without deforming of the key top 12 by the link structure 18, the dome 20 can be pressed, and the contact portion 30 can be pushed by the contact pushing member 20B. As a result, the key switch structure 10 can function in a satisfactory manner, and it can be possible to obtain a thin key switch structure.

Also, if the operator releases the key top 12, the key top 12 can move to an original position while keeping parallel in the leaving direction from the membrane sheet 22 by the dome 20 and the link structure 18, and the contact pushing member 20B can be separated from the contact portion 30. As a result, the membrane sheet 22 can be released from the pushing of the contact portion 30, and the electrical connection between the electrical contacts of the upper and under sheets can be released. Then, the circuit of the electrical contacts that can form the electrical switch can enter or assume an opened condition.

Second Embodiment

Figure 13A:
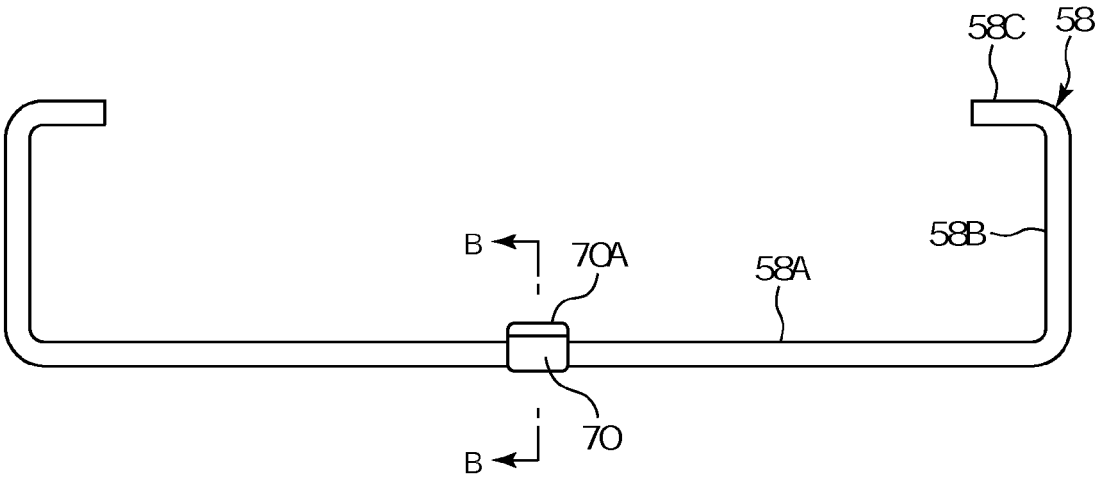
FIG. 13A is a plane view of an arm bar according to a second embodiment.
Figure 13B:
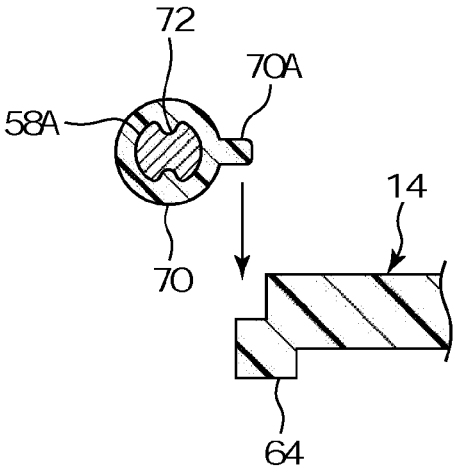
FIG. 13B is a cross-sectional view of a part of the arm bar and a part of the outside link member according to the second embodiment.

Next, a second embodiment of the key switch structure 10 will be described in reference to FIG. 13A and FIG. 13B. FIG. 13A is a plane view of the arm bar 58 according to the second embodiment. FIG. 13B is a cross-sectional view of a part of the arm bar 58 and a part of the outside link member 14 according to the second embodiment. Elements identical to those of the first embodiment will be designated by the same reference numbers, and results based on inclusion of the identical elements will be incorporated herein by reference. In the key switch structure 10 of the second embodiment, a configuration of the arm bar 58 can be different from that of the first embodiment.

In the arm bar 58 of the second embodiment, a projection member 70 made of or including, for example, a synthetic resin, can be formed integrally at substantially the center part of the long part 58A. Also, a projection 70A serving as a pushing member that can push the receiver 64 can be formed at the projection member 70. Also, a groove 72 serving as a baffle can be formed at the part of the long part 58A where the projection member 70 can be formed. In the arm bar 58 of the second embodiment, if the key top 12 is pushed by the operator, the projection 70A can push the receiver 64 as with the first embodiment.

Third Embodiment

Figure 14:
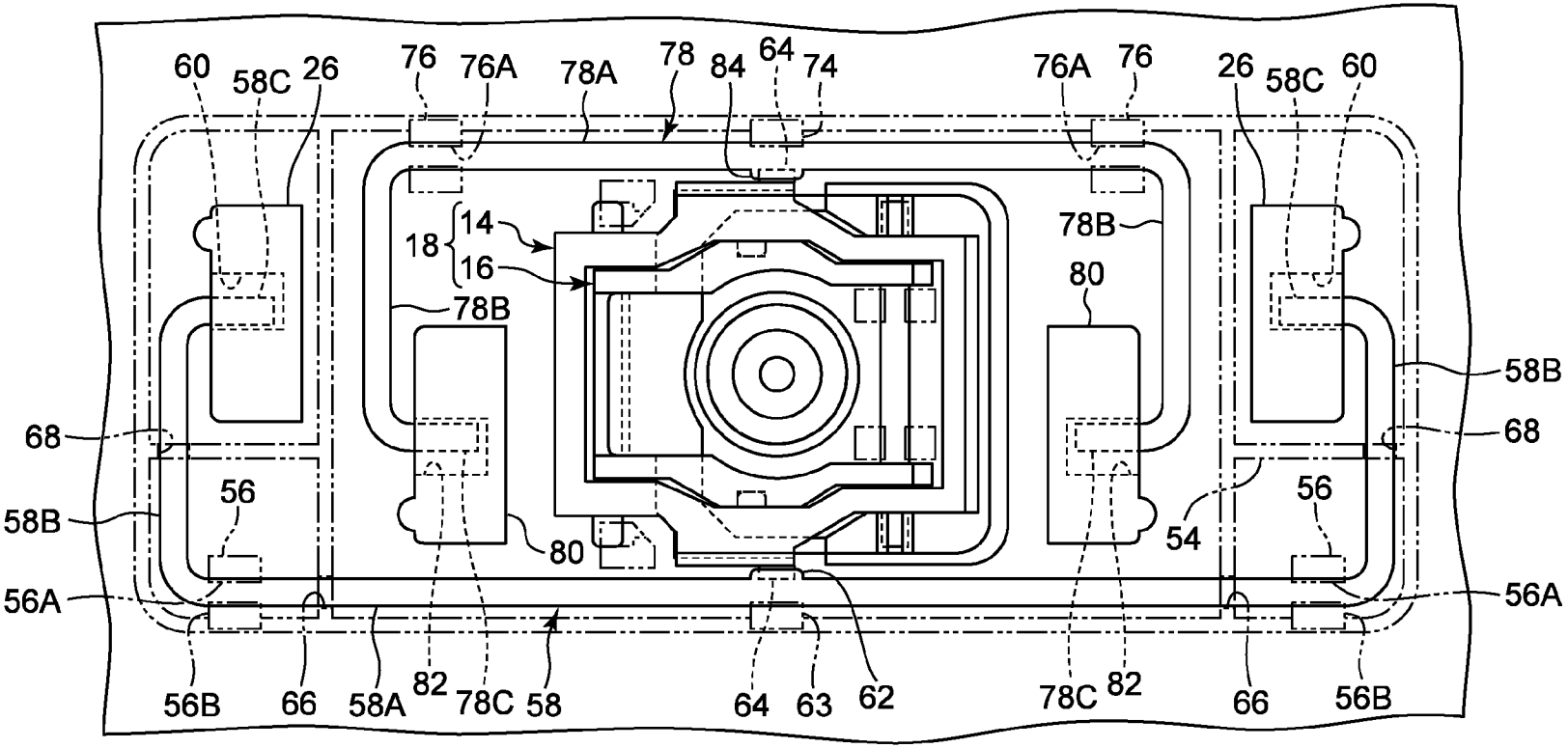
FIG. 14 is a plane view illustrating an inside of the key switch structure according to a third embodiment.
Figure 15:
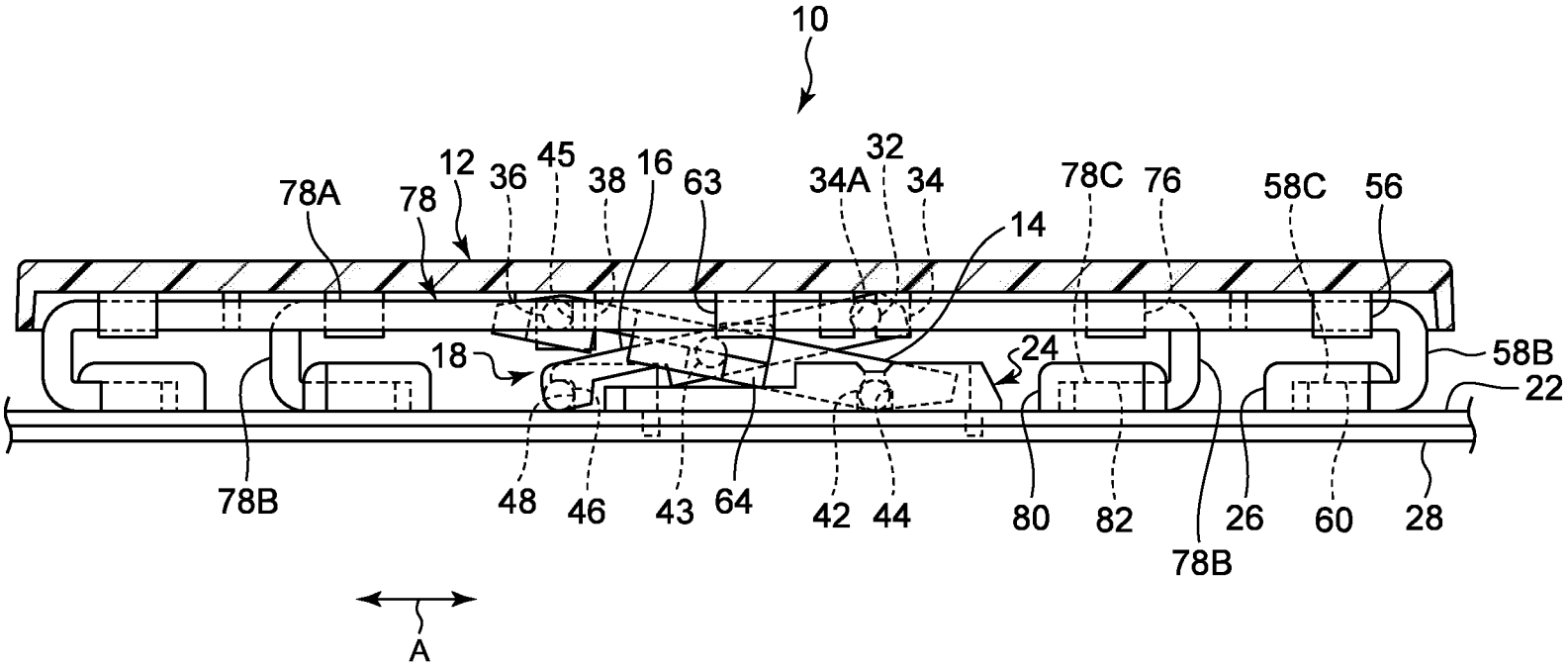
FIG. 15 is a cross-sectional view of the key switch structure according to the third embodiment.
Figure 16:
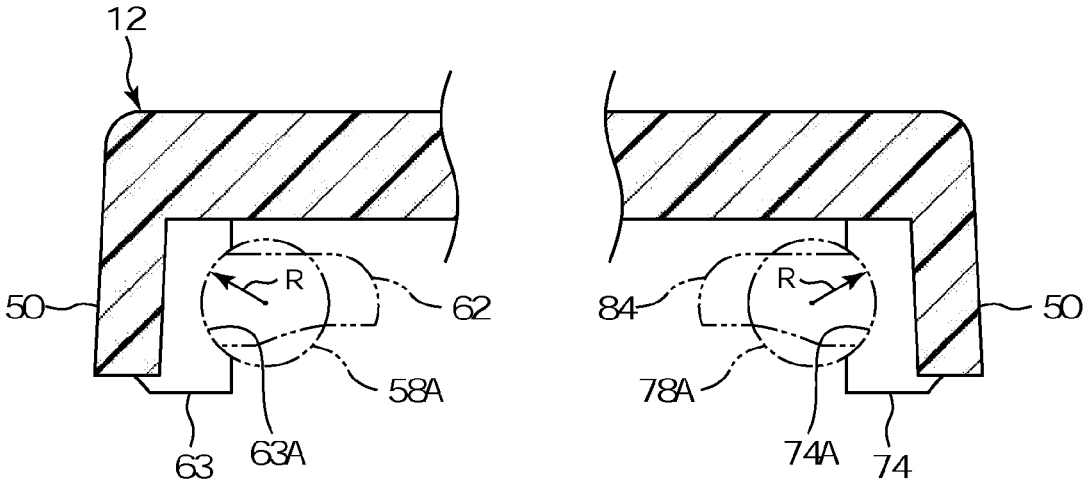
FIG. 16 is a cross-sectional view of a part of the key switch structure according to the third embodiment.
Figure 17:
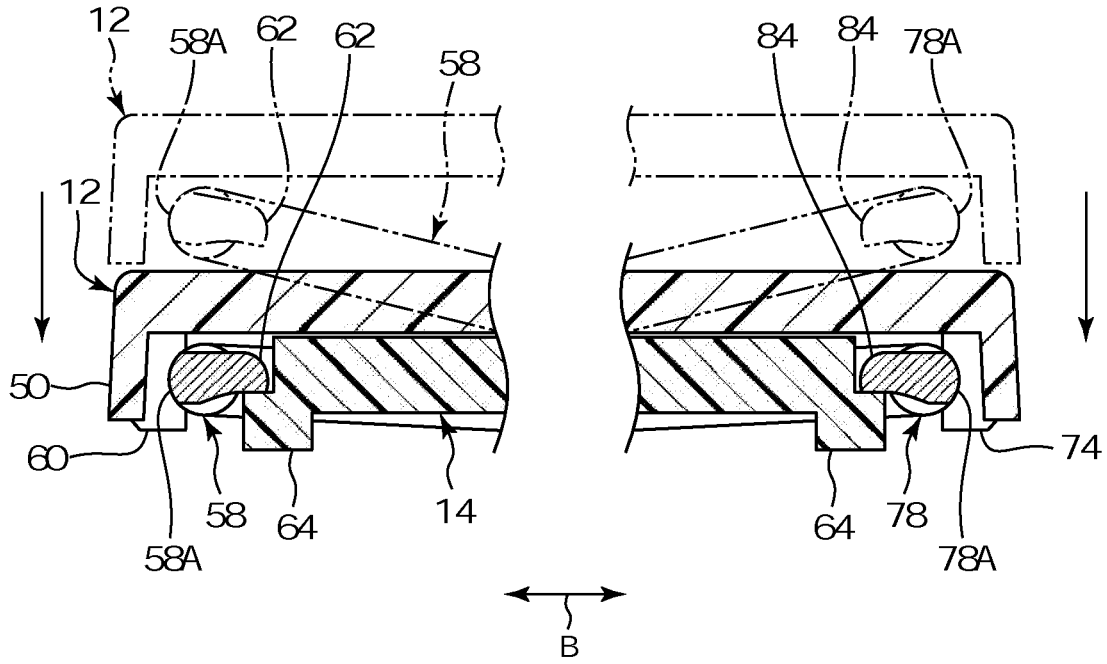
FIG. 17 is a cross-sectional view of a part of the key switch structure while the arm bars and the outside link member are in a pressed position.
Figure 18A:
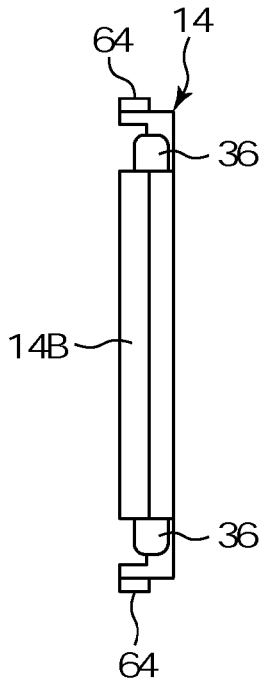
FIG. 18A is a side view of the outside link member according to the third embodiment.
Figure 18B:
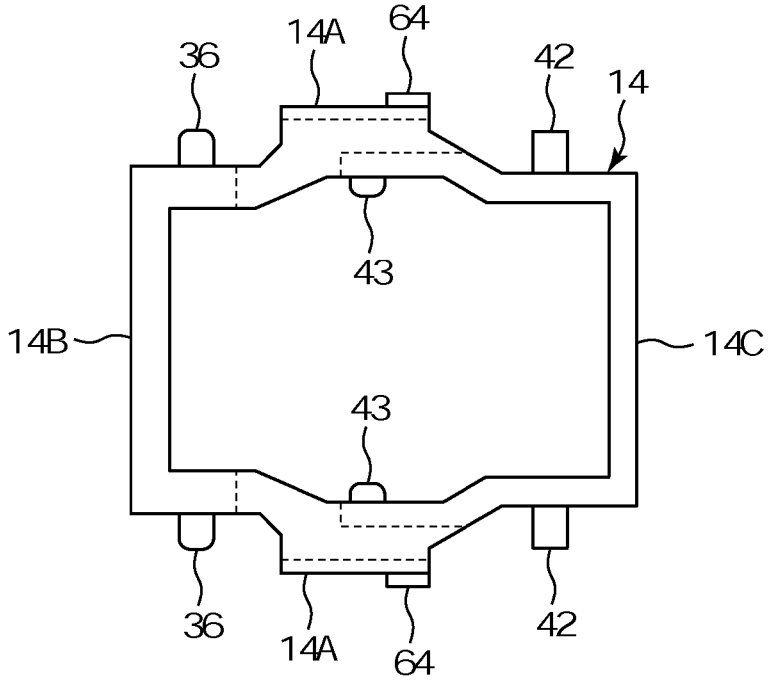
FIG. 18B is a plane view of the outside link member according to the third embodiment.
Figure 18C:
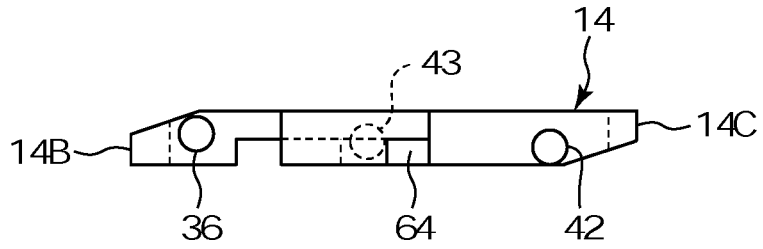
FIG. 18C is another side view of the outside link member according to the third embodiment.

Next, the key switch structure 10 of a third embodiment will be described with reference to FIGS. 14-18C. FIG. 14 is a plane view illustrating an inside of the key switch structure 10 according to the third embodiment. FIG. 15 is a cross-sectional view of the key switch structure 10 according to the third embodiment. FIG. 16 is a cross-sectional view of a part of the key switch structure 10 according to the third embodiment. FIG. 17 is a cross-sectional view of a part of the key switch structure 10 while the arm bar 58, an arm bar 78, and the outside link member 14 are in a pressed position. FIG. 18A is a side view of the outside link member 14 according to the third embodiment. FIG. 18B is a plane view of the outside link member 14 according to the third embodiment. FIG. 18C is another side view of the outside link member 14 according to the third embodiment. Elements identical to those of the first embodiment will be designated by the same reference numbers, and results based on inclusion of the identical elements will be incorporated herein by reference. As shown in FIG. 14, and FIG. 15, in the key switch structure 10, an arm bar 78 that can have a composition nearly identical to a composition of the arm bar 58 can be arranged at opposite side to the arm bar 58. In the arm bar 78 shown in FIG. 14, reference numbers 78A, 78B, and 78C show respectively a long part, a short part, and a hinge part, and those parts can have respectively identical compositions to the parts 58A, 58B, and 58C.

Third holders 80 that can have identical composition to the second holder 26 can be arranged at the back side of the key top 12, and supporting holes 82 that can have a composition identical to a composition of the supporting holes 60 can be formed respectively at the third holders 80. The hinge parts 78C can be inserted respectively into the supporting holes 82.

As shown in FIG. 14, and FIG. 16, at the back side of the key top 12, a receiver 74 that can have a shape identical to a shape of the receiver 63 can be formed at an opposite side to the receiver 63, and supporting members 76 that can have a shape identical to a shape of the supporting members 56 can be arranged at an opposite side to the respective supporting members 56. Reference numbers 74A, and 76A show respectively a guide face, and a hinge groove. The guide face 74A can have a composition identical to a composition of the guide face 63A, and the hinge groove 76A can have a composition identical to a composition of the hinge groove 56A.

The arm bar 78, for example formed by a metal wire that can be circular in cross-sectional, such as a stainless wire, can be inserted into the hinge groove 76A so as to be able to rotate with respect to the key top 12. As shown in FIG. 14, and FIG. 17, a projection 84 serving as a pushing member that can have a composition identical to a composition of the projection 62 can be formed at substantially the center part of the long part 78A.

As shown in FIG. 18, the outside link member 14 of this embodiment can include the formal receivers 64 at both sides thereof unlike the first embodiment. In the key switch structure 10, the arm bar 58 can be arranged at the one side of the key top 12 in the width direction of the key top 12, the arm bar 78 can be arranged at the other side of that, and the projections 62 and 84 can push the projections 64. Therefore, the link structure 18 can be pushed with a reduced failure rate compared to conventional structures so as to be lowered, the whole key top 12 can be moved toward the membrane sheet 22 while keeping parallel to the membrane sheet 22 and without deforming of the key top 12 by the link structure 18, the dome 20 can be pressed, and the contact portion 30 can be pushed by the contact pushing member 20B. As a result, the key switch structure 10 can function in a satisfactory manner, and it can be possible to obtain a thin key switch structure.

In the key switch structure 10 of the third embodiment, a single link structure 18 is arranged with respect to a single key top 12. However, if the length of key top 12 is longer than the illustrated embodiments, plural link structures 10 can be arranged in the longer direction of the key top 12.

The invention is not limited in the described embodiments. According to the embodiments, the link structure relates to the key switch structure. However, the link structure can be used for other compositions of movable components that can include the link structure.

What has been described above includes examples of embodiments represented by the appended claims. It is, of course, not possible to describe every conceivable combination of components or methodologies encompassed by the claims, but it should be understood that many further combinations and permutations are possible. Accordingly, the claims are intended to embrace all such combinations, permutations, alterations, modifications and variations that fall within the spirit and scope of the claims. Moreover, the above description, and the Abstract, are not intended to be exhaustive or to limit the spirit and scope of the claims to the precise forms disclosed.

What is claimed is:

1. A key switch structure, comprising:

a key top;

a link structure configured to support and guide the key top so that the key top moves in a pushing direction while the key top is pushed, and including a link member that supports the key top;

a back plate that supports the link structure;

a membrane sheet arranged on the back plate and facing toward the key top, and including a contact portion in the membrane sheet and connectable, in response to a predetermined pressure, to an electrical contact to form at least one closed circuit;

an elastic member arranged between the key top and the membrane sheet that pushes and separates the key top from the back plate, and is elastically deformable to transmit the predetermined pressure to the contact portion;

an arm bar that is arranged along a longer direction of the key top, and movably supports the key top, a part of the arm bar being supported movably at the back plate; and a pushing member arranged at the arm bar and configured to push the link structure while the key top is pushed, wherein the link member rotates with respect to the back plate while the key top moves in the pushing direction, and includes a receiver that faces toward the pushing member and that is closer to a rotational axis of the link member than an edge of the link member that contacts with the key top is, and the pushing member contacts with the receiver in the middle of the movement of the key to in the pushing direction.

2. The key switch structure of claim 1, wherein the pushing member includes a projection.

3. The key switch structure of claim 2, wherein the projection includes a part of the arm bar that projects beyond a main portion of the arm bar.

4. The key switch structure of claim 2, wherein the projection is formed from a different member from the arm bar.

5. The key switch structure of claim 1, wherein the receiver projects from a side of the link member.

6. The key switch structure of claim 1, wherein the key top includes a supporting member formed by a pair of stoppers that movably support the arm bar.

7. A key switch structure of claim 1, further comprising:

a second arm bar that is arranged along the longer direction of the key top across the link structure, and movably supports the key top, a part of the second arm bar being supported movably at the back plate; and a second pushing member arranged at the second arm bar and configured to push the link structure while the key top is pushed.

* * * * *